United States Patent [19]

Penick et al.

[11] 3,995,388

[45] Dec. 7, 1976

[54] POP-UP PRODUCTS AND METHOD OF MAKING

[75] Inventors: Ib Penick, Prospect Heights; John K. Volkert, Northfield, both of Ill.

[73] Assignee: Compak Systems, Inc., Northfield, Ill.

[22] Filed: Dec. 8, 1975

[21] Appl. No.: 638,558

[52] U.S. Cl. ..... 40/126 A; 40/160; 46/37

[51] Int. Cl.[2] ..... G09F 19/00

[58] Field of Search ..... 40/126 A, 160; 46/35, 46/36, 37

[56] References Cited

UNITED STATES PATENTS

| | | | |
|---|---|---|---|
| 1,124,639 | 1/1915 | Mott | 46/37 |
| 2,833,074 | 5/1958 | Jannes | 40/126 A |
| 3,807,771 | 4/1974 | Greason | 40/126 A |

*Primary Examiner*—Louis G. Mancene
*Assistant Examiner*—Robert F. Cutting
*Attorney, Agent, or Firm*—Fitch, Even, Tabin & Luedeka

[57] ABSTRACT

A pop-up dimensional or specialty product which is designed for mass-production mechanical fabrication and assembly. A basepiece is formed from sheet material including a plurality of base panels, and a separate pop-up element is attached to two different base panels. Adhesive is applied to a subelement of one pop-up element, and after bringing the base panels into superposed relationship, as by folding, the subelement becomes adhesively attached to a subelement of the other pop-up element. Upon unfolding of the basepiece, the pop-up elements stand up out of the plane thereof.

17 Claims, 23 Drawing Figures

45
43
49
47
47
39
41
33
37
35

47'
49'
47'
39'
41'
33
35
37
47'
49'
39'
37'
38
33'
49'
39'
37'
38
33'
47'

33'
33'
38

33'
37'
47'
38
39'
38
39'
47'

38

46
42
37"
40
50c
44
50b
33"
50

50a
50c
38"

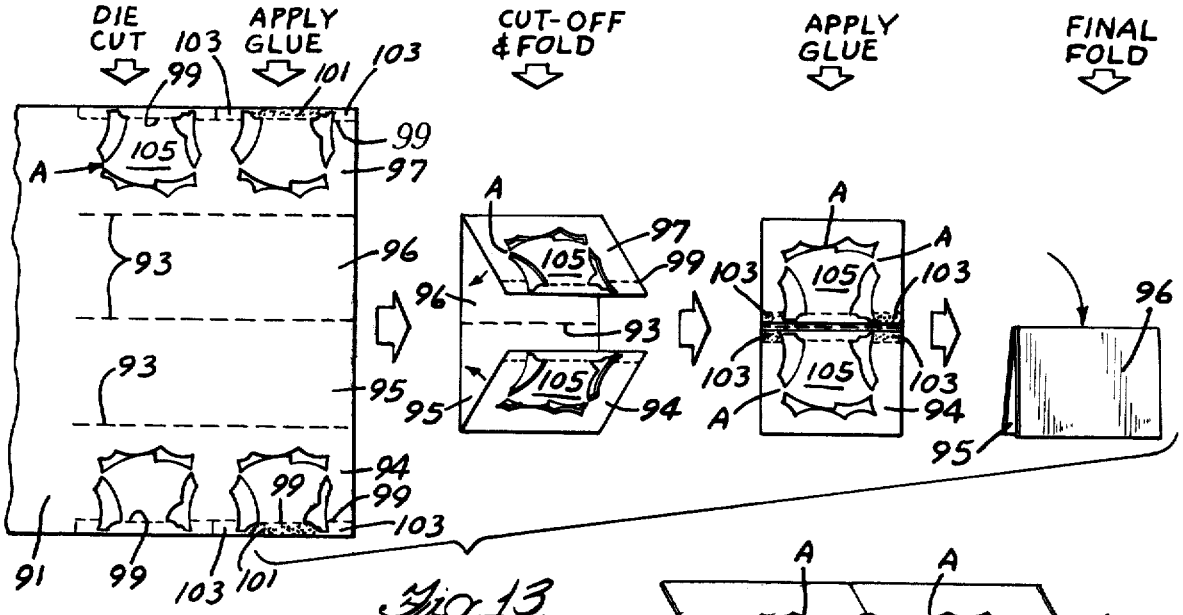
Fig. 13.
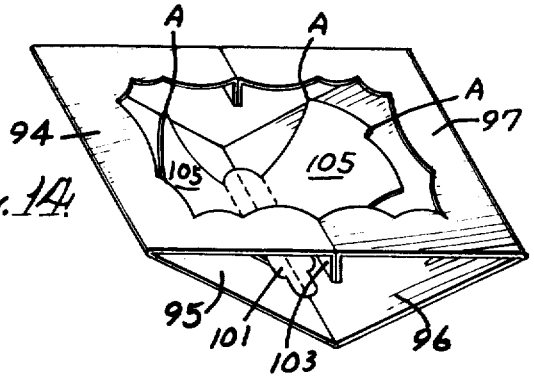
Fig. 14.
Fig. 15.
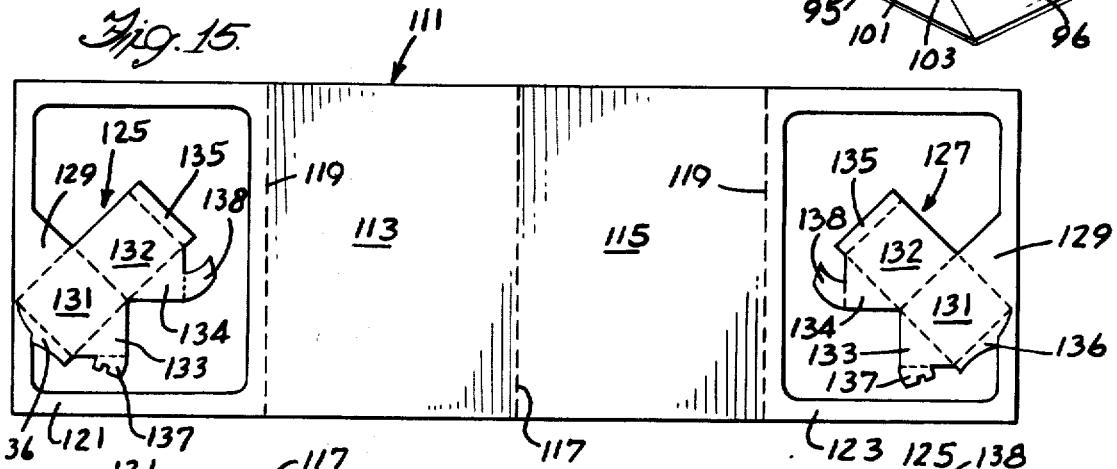
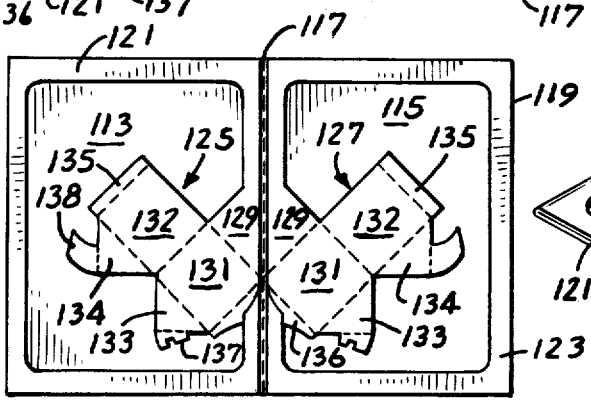
Fig. 16.
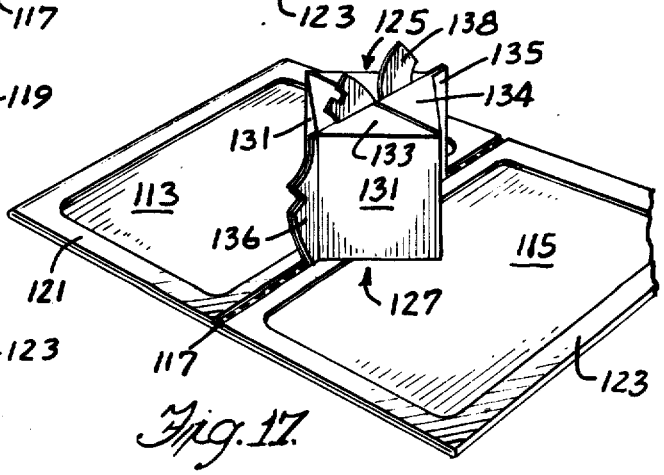
Fig. 17.

POP-UP PRODUCTS AND METHOD OF MAKING

This invention relates to printed paper novelty devices of various types, and more particularly to dimensional and speciality paper products of this character wherein a "pop-up" is provided which moves to a position out of the plane of the remainder of the item upon opening of the device.

Advertising hand-outs, inserts, mailers and displays, novelty items, illustrations in children's books and in certain textbooks, greeting cards, and the like have for many years utilized pop-up devices which, upon opening of the pages or the covers of a folder, move out of the plane thereof and into a central or raised location where they attract attention and influence remembrance or retention, oftentimes by presenting a three-dimensional structure. These pop-up devices have generally required tedious and fairly expensive hand labor in folding and gluing to assemble the pop-up figure itself, and also they have required additional hand labor in affixing the pre-assembled pop-up figure in the folder or between the pages or covers wherein it is to be distributed. As a result, the use which has heretofore been made of such pop-up devices has been limited and has often resulted in the establishment of assembly-line fabrication operations in regions of the world wherein unskilled labor is relatively inexpensive. There is a ready market for pop-up items of this character, for example, in advertising folders, magazine inserts, sales displays, book illustrations, greeting cards and like fields, if such pop-up items can be inexpensively mass-produced in ways which eliminate the need for manual labor.

It is an object of the present invention to provide a design for an item of this character which allows a pop-up construction to be created that is capable of fabrication by mechanical mass-production A further object of the invention is to provide a design for a pop-up construction for items of this character that is susceptible to rapid, automatic fabrication and which is adapted for mechanical insertion and/or binding into magazines or the like for mass distribution.

Another object of the invention is to provide a method for making an item of this character embodying a pop-up construction utilizing a series of automatically controllable mechanical steps which do not involve the need for hand labor.

These and other objects of the invention will become apparent from the following detailed description of different constructions embodying features of the invention, particularly when read in conjunction with the accompanying drawings wherein:

FIGS. 1 to 4 show alternative constructions of blanks which are designed for fabrication into a substantially similar folder;

FIG. 5 generally depicts the blanks of FIGS. 1 to 4 after a first folding operation has been effected;

FIG. 13 diagrammatically shows a series of steps depicting an automatic method for the formation of pop-up items embodying various features of the invention from a continuous web of sheet material;

FIG. 14 is an enlarged perspective view of the opened pop-up construction manufactured by the method as shown in FIG. 13;

FIG. 15 is a plan view of a blank designed for the fabrication of another pop-up design embodying various features of the invention;

FIG. 16 shows the blank of FIG. 15 after an initial folding step; and

FIG. 17 shows a view of the finished item fabricated from the blank of FIG. 15.

It has been found that advertising folders, greeting cards and other such items can be inexpensively created by forming pop-up elements of a character such that they can be formed as a part of or otherwise appropriately attached to a base panel in a substantially flat unfolded condition. Adhesive is selectively applied to the pop-up element, and two such pop-up carrying base panels are brought into superposed condition, as for example by folding the hinged base panels atop each other. As soon as the adhesive sets, bonds between appropriate portions of the pop-up elements are achieved which create a pop-up motion upon opening the folder. As the base panels are moved to a generally planar, oftentimes horizontal orientation, the pop-up elements rise out of the plane thereof and into prominent view.

FIGS. 1 to 4 show four different blanks for forming a product generally similar in final construction. The term folder is hereinafter used, for purpose of convenience to describe the ultimate product because the product functions by unfolding or opening two hinged panels which carry the pop-up elements, and the use does not imply that a folding operation is necessary in its fabrication although such is preferred. Moreover, it should be understood that this term is meant to encompass greeting cards, advertising hand-outs and displays, three-dimensional illustrations for books, novelty items and the like.

Figure 1:
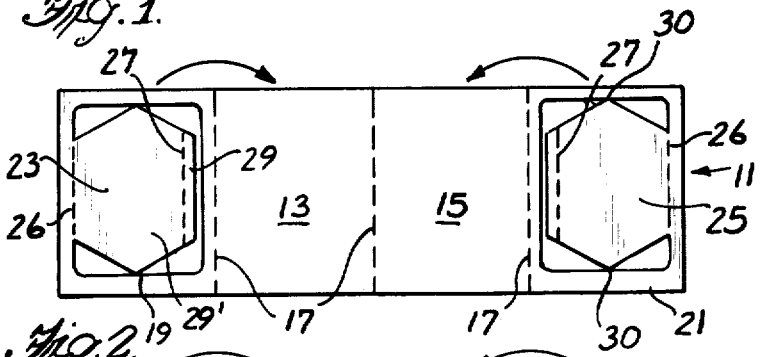

FIG. 1 illustrates a blank 11 wherein a pair of base panels 13 and 15 are provided centrally of four serially connected panels, which are defined by parallel score lines 17. The base panels 13, 15 provide a foldable basepiece and are flanked by a pair of panels 19 and 21 wherein the pop-up elements are created. In FIG. 1, a simple pop-up element is die-cut in the panels 19 and 21 to simply illustrate the principle; however, it should be understood that far more elaborate and decorative shapes can be die-cut or cut in any other suitable fashion. The illustrated die-cutting is such as to provide pop-up elements 23, 25 of generally hexagonal shape within an outer peripheral frame.

At one side edge, each pop-up element 23, 25 is completely severed from the panel 19, 21, whereas at the other side edge, a score line 26 is formed. Although the terminology score line is used through the specification for purposes of convenience, it should be understood to encompass any type of a line of weakness, such as crease lines and even perforations. Moreover, a parallel score line 27 is disposed in each pop-up element 23, 25 dividing it into small and large subelements 29, 29'. If desired to facilitate subsequent machine handling, the die-cutting can be incomplete at the upper and lower points 30 of the hexagon (as viewed in FIG. 1) thereby leaving two weak points of attachment which can be easily torn but which will facilitate handling the die-cut blank as a single unit without flapping of paper.

Figure 5:
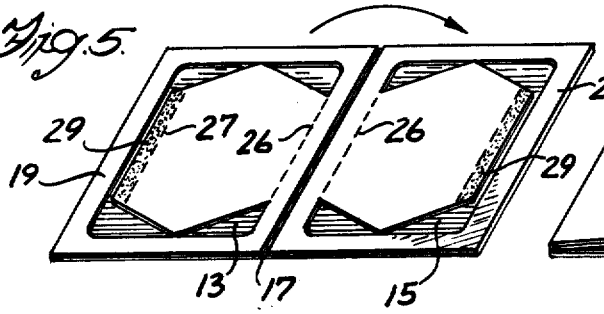

Once die-cutting is complete, adhesive is preferably applied to the frame portions of the pop-up panels 19 and 21 (or alternatively to corresponding locations on the base panels 13 and 15), and then the blank is folded about the pair of outermost score lines 17 to achieve the flat configuration depicted in FIG. 5. The adhesive bonds the peripheral frame portions of the pop-up panels 19, 21 to the underlying base panels 13, 15, but the pop-up elements 23, 25 remain free to move away from the base panels once the weak bonds created by the incomplete die-cutting are torn.

Figure 4:
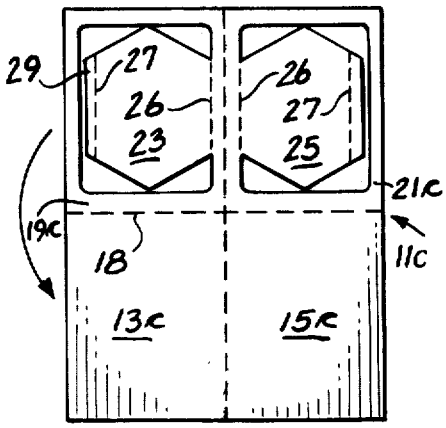
Figure 2:
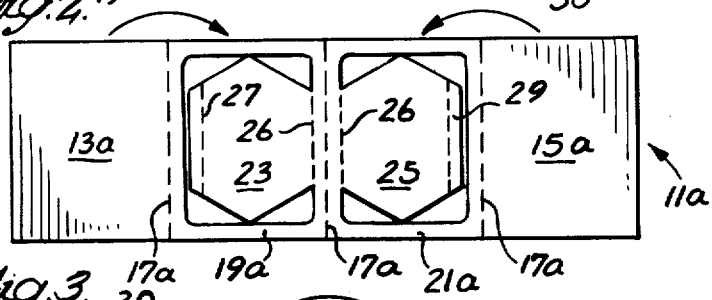
Figure 3:
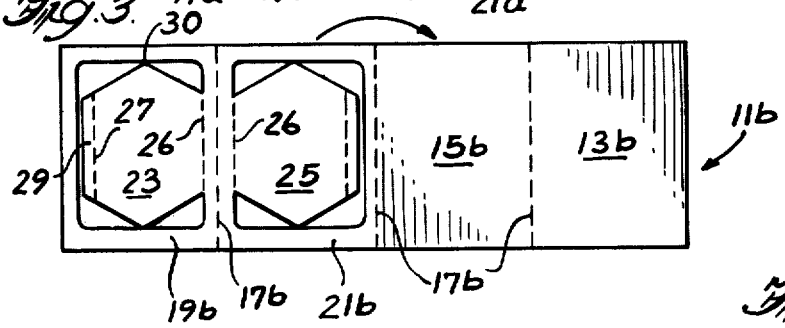

As indicated above, FIGS. 2, 3 and 4 show alternate embodiments of blanks for creating constructions substantially similar to that depicted in FIG. 5. These three blanks are now briefly described before discussing the completion of the fabriction process for the folder.

In FIG. 2, a blank 11*a* is shown wherein base panels 13a and 15a are located at opposite ends of the series of four panels, so that pop-up panels 19*a* and 21*a* are disposed centrally. Moreover, after a similar application of adhesive and folding of the panels about the outermost pair of fold lines 17*a*, the frames of the panels 19*a* and 21*a* become secured, respectively, to the base panels 13*a* and 15*a*, creating a similar construction to that shown in FIG. 5. Although in this construction the base panels 13*a* and 15*a* are not connected together by a central score line, the construction is similarly foldable about the central fold line 17*a* which hinges the two pop-up panels to the frame portions of which the base panels are glued.

In FIG. 3, a blank 11b is illustrated wherein two base panels 13*b*, 15*b* are located at the one end of the series of four panels, and two pop-up panels 19*b* and 21*b* are located at the other end. However, the application of adhesive at the appropriate locations of the pop-up frames and the folding about the central fold line 17*b* creates a construction substantially the same as that depicted in FIG. 5.

FIG. 4 shows a blank 11*c* that is squarer in shape than the elongated rectangular shapes of FIGS. 1–3. In this blank, base panels 13*c* and 15*c* are disposed side-by-side below pop-up panels 19*c* and 21*c*. After the application of adhesive, the pop-up panels are folded downward about a lateral score line 18, and a construction substantially similar to that depicted in FIG. 5 results.

An appropriate adhesive is then suitably applied to the small subelement 29 of either or both of the pop-up elements 23, 25, as indicated by the cross-hatching shown in FIG. 5, which pop-up elements are mirror images of each other. Depending upon the adhesive applied, folding the flat assembly about the central score line 17 may complete the fabrication, as when a solvent-based or hot-melt adhesive having substantial tackiness is used, resulting in the configuration shown in FIG. 6. It is also possible that a heat-activated on ultrasonic-activated adhesive could be applied at the above-mentioned time (or even before die-cutting) and allowed to dry before folding. In such case, the adhesive bond is achieved by exposing the folded assembly shown in FIG. 6 to compression plus heat or ultrasonic energy.

Figure 7:
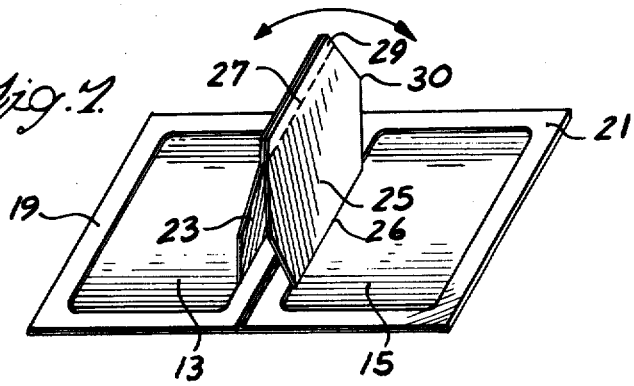
FIG. 7 shows the folder of FIG. 6 after opening.

After the adhesive bond is achieved, either with or without compression, whenever a recipient of the folder opens the base panels 13 and 15 and spreads them to substantially horizontal orientation, as depicted in FIG. 7, the adhesive joinder between the small subelements 29 causes the weak points 30 of connection between the pop-up elements 23, 25 and their respective frames to be torn or severed and the pop-up elements to assume the upstanding configuration depicted in FIG. 7.

Figures 8, 8A, 9A, 9B, 9C, 9D, 9E:
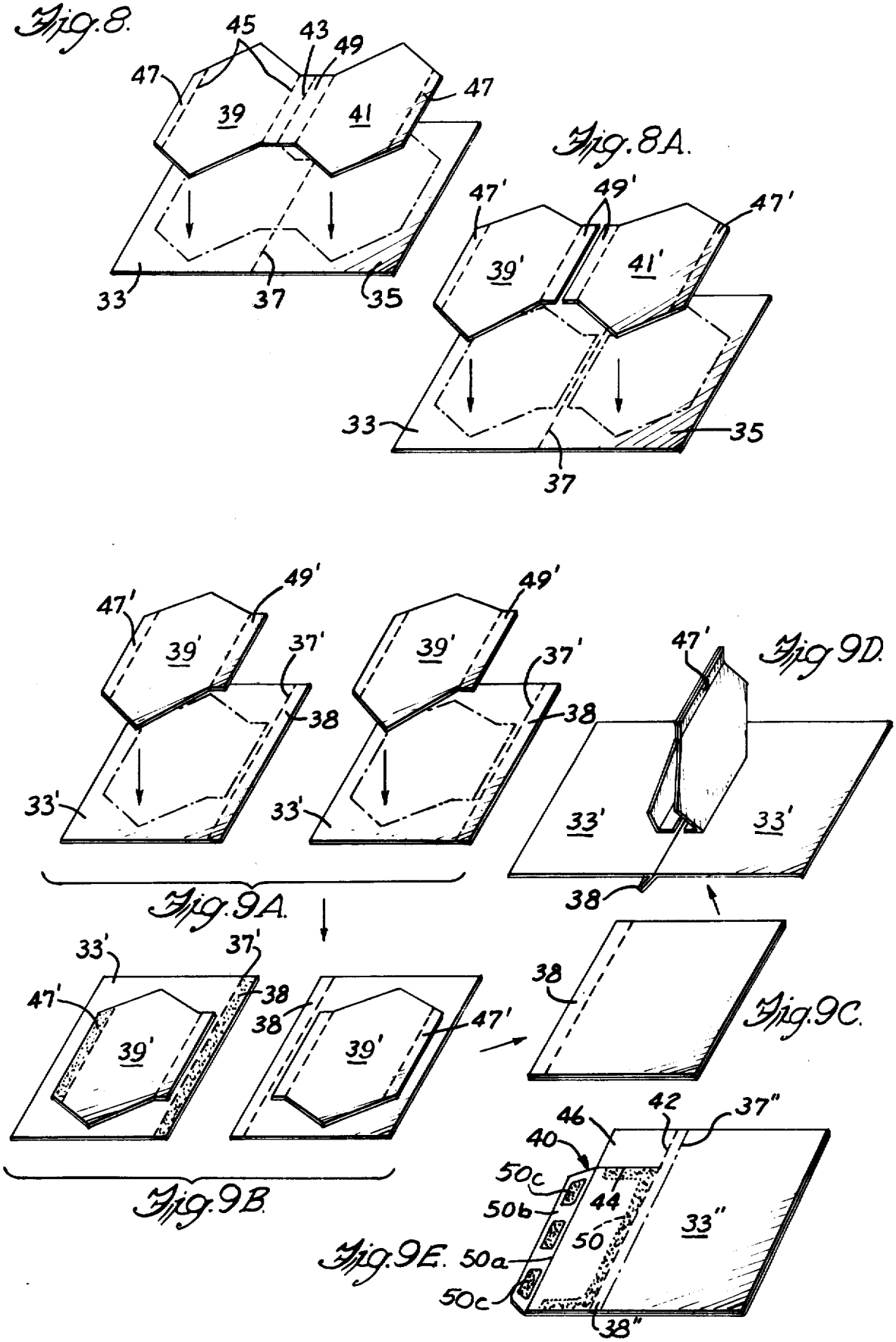
FIGS. 8 and 8A depict two alternative methods for forming folders generally similar to that illustrated in FIG. 7.
FIGS. 9A – 9D show still another method for making a folder similar to that shown in FIG. 7.
FIG. 9E depicts an alternative construction to that shown in FIG. 9C.

FIG. 8 depicts still another alternative version for achieving a pop-up generally similar to that depicted in FIG. 7. In FIG. 8, a basepiece is provided in the form of a pair of base panels 33 and 35 separated by a score line 37, and pop-up elements 39, 41 are provided by a separate piece cut from another sheet of the same or different material which includes a central score line 43. Each pop-up element 39, 41 includes two parallel score lines 45, the outermost of which create small subelements 47, similar to the subelements 29, and the innermost of which define tabs 49 by which the pop-up assembly is adhered to the base panels 33, 35. Accordingly, adhesive is first applied either to the underside of the tabs 49 or to the appropriate location on the basepiece, and then the pop-up assembly is placed flat atop the basepiece with the central score line 43 aligned with the score 37, as indicated in dotted outline.

Figure 6:
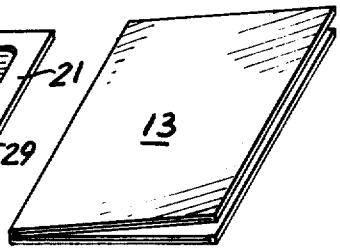
FIG. 6 shows the folded blank of FIG. 5 after a subsequent folding step.

Adhesive is applied to at least one of the subelements 47, and the construction is folded about the central score line 37 in the manner illustrated in FIG. 6. After the adhesive bond is complexed, opening of the folder causes the pop-up device to extend upward out of the plane of the basepiece and to resemble that depicted in FIG. 7, except for the absence of the peripheral frames. However, if desired either to assist in collation or just for visual effect, the pop-up elements 39, 41 could be formed with surrounding frames as in FIGS. 1 to 7.

FIG. 8A shows an alternative to the embodiment shown in FIG. 8 wherein two pop-up elements 39' and 41' are cut out separately and are separately adhered to the base panel 33, 35. It is preferable that the tab portions 49' of the pop-up elements 39', 41' are proportioned about the same as those on the construction depicted in FIG. 8 so that they will extend nearly to the central score line 37 of the basepiece and thus facilitate more precise alignment, as depicted in dotted outline. However, if desired, the tabs 49' could be made still smaller in width and thus glued to the base panels at locations spaced slightly further from the central score line 37. Once the separate pop-up elements are attached to the basepiece in flat form, the further application of adhesive and folding is the same as described with respect to the assembly shown in FIG. 8.

FIG. 9A through 9D show still another alternative method for making a pop-up construction generally similar to that which would be formed by the methods shown in FIGS. 8 and 8A; however, this method does not entail a folding operation as one of the fabrication steps. A pair of the pop-up elements 39' which were employed in FIG. 8A are respectively associated with a pair of single base panels 33', each of which includes a score line 37' located along the righthand edge and defining a flap 38. Adhesive is appied either to the undersurface of the tabs 49' or to the corresponding location on the base panels 33', and the pop-up elements 39' are then attached to the base panels as depicted in dotted outline in FIG. 9A.

The right-hand subassembly is then rotated 180° in its plane to achieve the orientation depicted in FIG. 9B, and then adhesive is suitably applied to the subelement 47' of one of the pop-up elements and to one of the flaps 38, as depicted by the cross-hatching in FIG. 9B. Alternatively, adhesive could be applied to both flaps 38 and to both subelements 47', if desired. Then one of the subassemblies is flipped over to bring them into superposed condition as depicted in FIG. 9C, and compression may be employed while the adhesive sets and results in the creation of a folder. Opening of the folder is depicted in FIG. 9D, and except for the glued-together flaps 38, the folder is the same as that which would result from the embodiment depicted in FIG. 8A. The presence of the flaps 38 can be utilized to bind the item between the pages of a mass-distribution magazine or other like publication.

Shown in FIG. 9E is an alternative embodiment to the item depicted in FIGS. 9A through 9D wherein the flap along which the two subassemblies are connected together is used as more than a binding flap. A pair of base panels 33'' are provided, each of which is defined along one edge by a line of weakness 37''. On the opposite side of the line of weakness 37'' there is provided a connection flap 38'' plus an extension panel 40. A line of perforations 42 is provided, and the connection flap 38'' lies between the perforations 42 and the line of weakness 37''. The lines of perforation 42 will usually be formed in the upper and lower pieces of sheet material after they are aligned, at which time a cut or slit 44 is also formed that runs transverse to the line of perforations and defines a detachable pair of cards or coupons 46 which lie in superposed position in the ultimate item.

The superposed portions of the extension panels 40 in the region below the slit 44 are glued or otherwise adhesively connected together along a U-shaped line 50 to form the pocket of an envelope 50*a*. The underneath sheet is slightly wider at the region of the envelope to provide a fold-over flap 50b, that is provided with remoistenable adhesive 50c to seal the envelope before mailing. Thus, in the version depicted in FIG. 9E, a combination item is provided which includes not only a pop-up folder, but also a mailing envelope plus a pair of cards or coupons which might be returned in such envelope.

An item of this type may be included in the centerfold of a mass-distribution magazine, wherein the envelope and coupons would be normally related to the subject matter of the pop-up folder. On the other hand, the item could be placed somewhere between the pages of the mass-distribution magazine so that the envelope and coupons will be separated from the pop-up folder by a number of pages and thus would likely be directed to different subjects. Of course, the item need not be restricted to magazine distribution, as it is equally suited for use as a hand-out.

Figure 10:
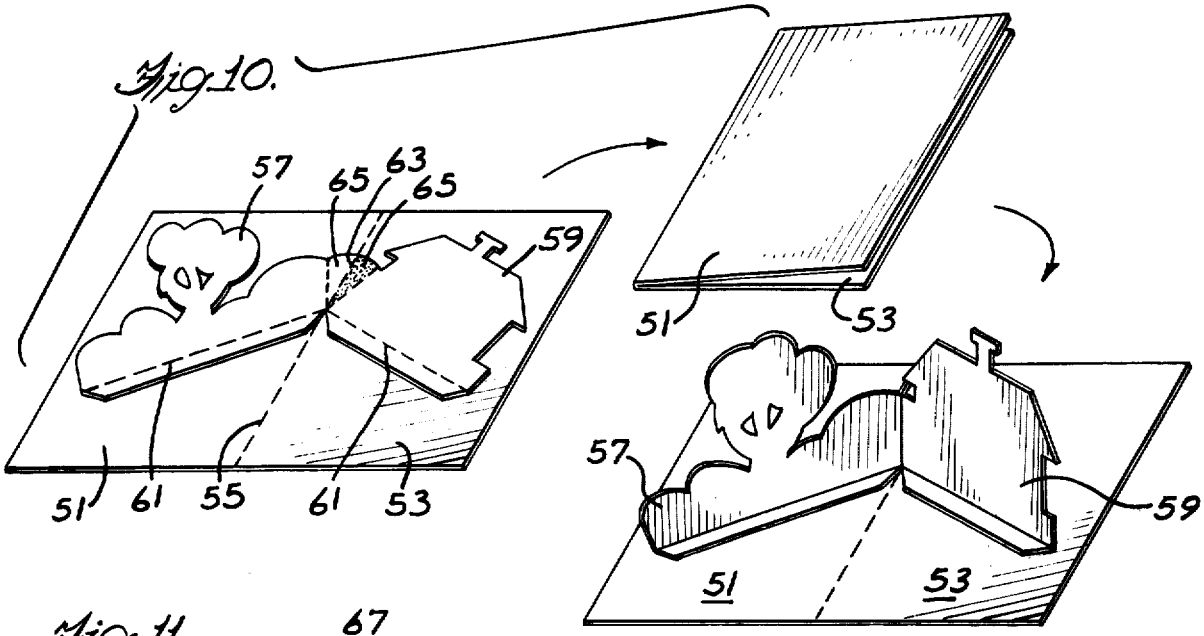
FIG. 10 illustrates the fabrication of another type of pop-up folder embodying various features of the invention.

FIG. 10 depicts a pop-up construction other than the heretofore illustrated mirror image concept, wherein each of the pop-up elements has an entirely different shape. Illustrated is a basepiece comprising a pair of panels 51 and 53 separated by a central score line 55. The pop-up subassembly is die-cut from a single sheet of material and includes one pop-up element 57 in the form of a shape of a tree and another pop-up element 59 in the form of a house. Both pop-up elements include score lines which define elongated lower tabs 61 which are suitably attached, as by gluing, to the upper surface of the basepiece to create the pop-up assembly shown in the initial view of FIG. 10. In addition, the pop-up subassembly contains a central score line 63, which becomes aligned with the score line of 55 of the basepiece, plus a pair of flanking, annularly disposed score lines which create generally triangular-shaped subelements 65. Thereafter, adhesive is applied to one or both subelements 65, and folding is carried out, as depicted in the central figure, to superpose the base panel 51 over the base panel 53 and the pop-up subelements 65 over each other. After adhesion of the subelements 65 to each other is complete, opening of the folder by spreading the base panels 51, 53 apart causes the pop-up elements 57, 59 to stand upward upon the basepiece, being hinged thereto along the tabs 61, as depicted in the last view of FIG. 10.

Figure 11:
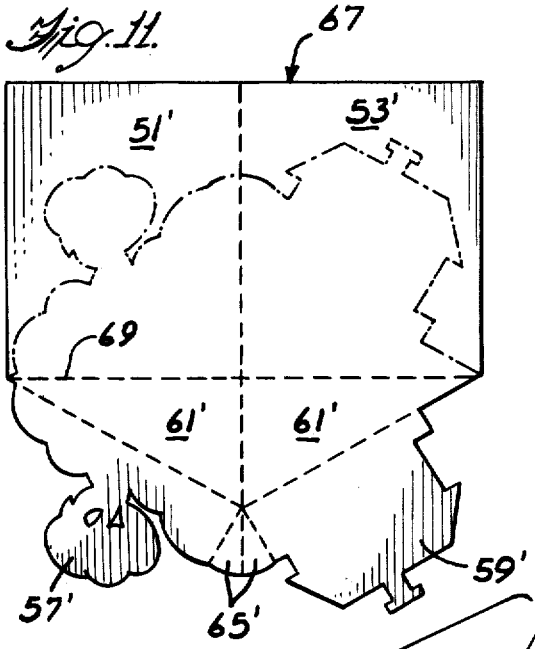
FIGS. 11 and 11A depict alternative blank constructions for making a folder of the general type shown in FIG. 10.

FIG. 11 depicts a blank 67 from which a construction substantially similar to the shown in FIG. 10 is created. In the blank 67 base panels 51' and 53' plus a pop-up assembly are die-cut from a single sheet of material. Two pop-up elements 57' and 59' are respectively connected by large triangular tabs 61' which are hinged along the bottom edge 69 of the basepiece. Preferably, the traingular tabs 61' are glued or otherwise suitably adhered to the upper surface of the basepiece; however, the pop-up subassembly can be allowed to merely lie in contact with the basepiece, as depicted in dotted outline, without being affixed thereto, relying upon the length of joinder along the tabs 61' to provide the acuating connection. The subsequent application of adhesive to the top surface of at least one of the triangular subelements 65' and the ultimate folding is carried out as depicted and described in regard to FIG. 10.

Figure 11A:
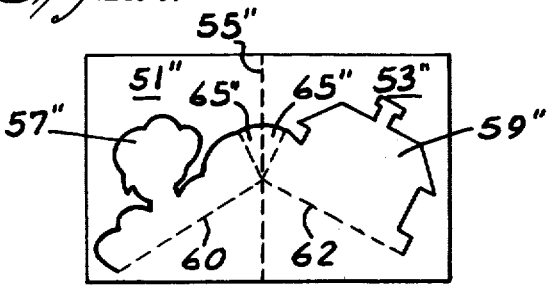

Shown in FIG. 11A is another alternative blank construction for making a folder of the general type shown in FIG. 10. In this embodiment, a single sheet of material is employed, and although it might be preferable to use a slightly heavier weight stock, sheet material, this is not a requirement. The single sheet contains a central line of weakness 55'' which divides the sheet into base panels 51''and 53''. The pop-up elements 57'' and 50'' are cut directly from the base sheet itself. The die-cutting is such that both pop-up elements are left hinged to the remainder of the base panels along score lines 60 and 62. Each pop-up element contains an additional score line which divides it into subelements, creating the generally triangular shaped subelements 65''.

Application of adhesive onto one or both of the subelements 65'' is followed by folding of the base panels about the central line of weakness 55'' to bring them into superposed relation and thereby complete the fabrication. Opening of the folder produces the same general effect depicted in the final figure of FIG. 10, with the exception that the holes remaining in the regions of the base panels from which the pop-up elements were die-cut would appear behind the upstanding pop-up assembly. Should this be aesthetically undesirable, opaque sheeting may be glued or otherwise secured to the exterior of the folder to obscure the cut-outs. Moreover, this construction might be employed as a part of a menu or the like where the pop-up assembly would only constitute a small portion of the overall area of the basepiece.

Figure 12:
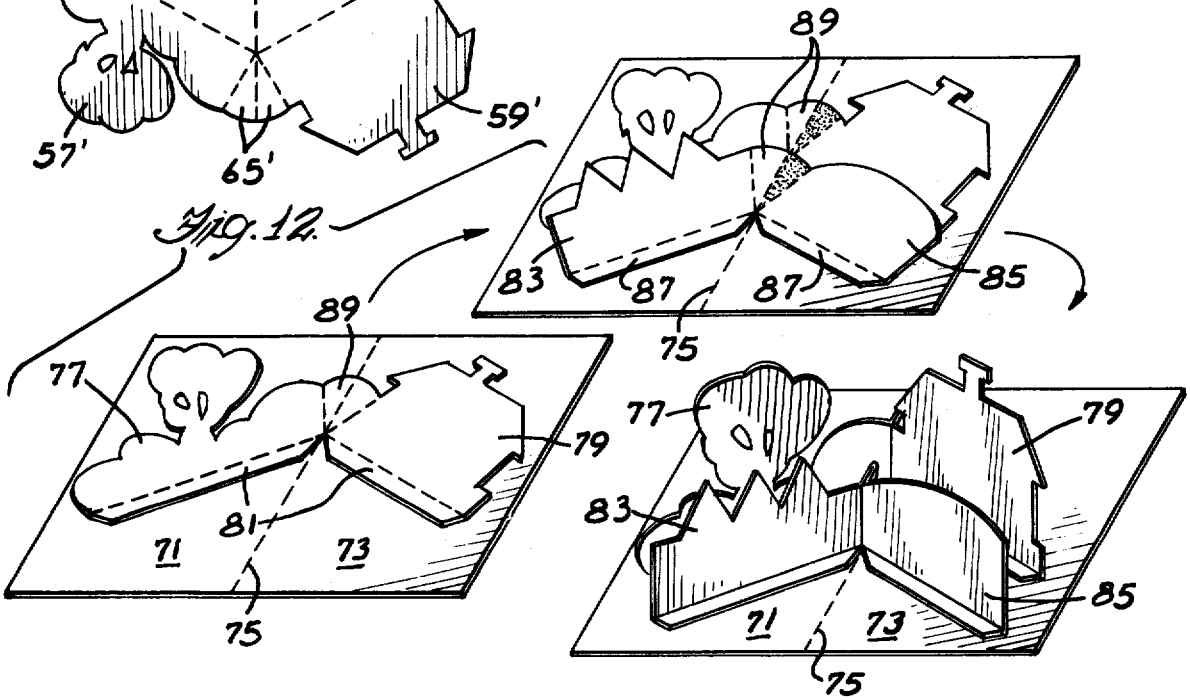
FIG. 12 depicts another construction of a pop-up item embodying various features of the invention.

FIG. 12 depicts a construction wherein multiple pop-up subassemblies are affixed to a single basepiece, each being secured generally as in the same manner as depicted in FIG. 10. The lefthand view of the FIG. 12 shows a basepiece in the form of a pair of base panels 71, 73 of equal size separated by a central score line 75; however, the panels could differ in size if desired to achieve a desired effect. A first pop-up subassembly including pop-up elements 77 and 79 is affixed in place by adhering tabs 81 to the upper surface of the basepiece in a manner so that the pop-up elements are located on opposite sides of the score line 75. As illustrated in the middle view, a second pop-up assembly containing pop-up elements 83 and 85 is affixed at a slightly lower location on the basepiece by gluing tabs 87 thereto.

Each pop-up element contains an angularly disposed line of weakness which creates a subelement 89 of a generally triangular shape lying just adjacent the central line 75 of the basepiece. Adhesive is then applied to the upper surface of at least one subelement 89 of each pop-up assembly, and the basepiece is then folded 180° about the central line 75 to bring the base panels 71, 73 into superposed relationship. After the adhesive bond has been established, opening the folder by spreading the base panels 71, 73 apart to a generally planar construction, as depicted in the righthand view of FIG. 12, causes both of the pop-up assemblies to rise from the plane of the basepiece providing an attractive, upstanding construction. Alternatively, the rear pop-up could be applied as depicted in FIG. 12 to a blank of the type shown in FIG. 11 wherein the front pop-up assembly is formed integrally, attached by the triangular tabs.

FIG. 13 is a diagrammatic representation of an automatic method of making pop-up constructions embodying various features of the invention, starting with a continuous web 91 of sheet material. In the depicted method, the web 91 should be understood as being moved in a left-to-right direction. The web first passes a die-cutting station where three lines of weakness 93 are created, defining four serially connected pannels 94, 95, 96 and 97, and where significant portions are removed from the outermost pair of panels 94, 97 to create pop-up elements. An additional line of weakness 99 is formed adjacent the upper and lower edges of the web 91 to create glue tabs 101 flanked by pairs of pop-up subelements 103.

A suitable adhesive is then applied to the upper surfaces of the glue tabs 101 as depicted; however, the adhesive could be earlier printed on the web 91 prior to diecutting particularly if a heat- or ultrasonic-activated adhesive is used. A severing operation is carried out to detach a single blank from the continuous web 91 for convenience of illustration; however, in a web press operation, it might be more common to carry out the folding operations, in web-form and not cut the web into individual items until they reach the final shape shown in the far right-hand stage of FIG. 13. Folding of the pop-up panels 94, 97 is then automatically effected as the blank continues its travel to the right to achieve the flat configuration depicted in the next-to-last view of FIG. 13 with the tabs 101 secured to base panels 95, 96. Thereafter, adhesive is automatically applied to the subelements 103 of the pop-up elements (or to only the upper or the lower subelements), and a final folding is effected about the central line of weakness 93 as the left-to-right travel of the blank continues. As soon as the adhesive bond sets, fabrication is complete; however, as indicated above, the application of heat or ultrasonics or the like might be needed to achieve a particular adhesive bond.

opening of the folder is depicted in FIG. 14. The web 91 is preferably made of relatively stiff paperboard, and it is the outer periphery of the pop-up panels 94 and 97 which constitute the pop-up elements. The bond between the tabs 101 and the base panels 95, 96 causes the weak bonds between the tabs and the flanking subelements 103 to be severed as opening of the folder takes place. The joinder of the subelements 103 prevents the base panels 95, 96 from being opened past a point where the pop-up elements 94, 97 assume a planar orientation, as is depicted in FIG. 14. A pair of auxiliary elements 105 are created by the die-cutting and are hinged to the tabs 101, and these elements initially remain connected to the surrounding pop-up elements at the points A which also constitute weak, easily tearable connections. As opening proceeds, the relative stiffness of the web material 91 from which the blank is made plus the reaction which occurs upon ruputre of the weakened connections at points A causes the auxiliary elements 105 to snap upward to locations separated from the plane of the base panels 95, 96, creating the eyepleasing effect shown in FIG. 14.

FIG. 15 shows a blank 111 designed to create a pop-up construction wherein there are multiple subelements that are glued together to create a more three-dimensional construction. The blank 111 includes a pair of base panels 113, 115 disposed about a central line of weakness 117, each base panel having a pop-up panel 121, 123 hinged thereto along parallel lines of weakness 119. The pop-up panels are die-cut to remove a substantial region of each of them, leaving a peripheral frame plus pop-up elements 125 and 127 which are essentially mirror images of each other. Each of the pop-up elements is connected by a score line to a generally triangular tab 129, and adhesive is applied to the tabs 129 and preferably also to desired locations on the peripheral frames (or to corresponding locations on the base panels 113, 115). Thereafter, folding is effected along the lines of weakness 119 to achieve the flat assembly shown in FIG. 16.

Each of the pop-up elements 125, 127 is divided into eight subelements by appropriate score lines. These eight subelements of each mirror image pop-up element include generally square body panels 131 and 132, generally triangular top panels 133 and 134 and connection panels 135, 136, 137 and 138. Adhesive is then appropriately applied to at least one of the connection panels of each pair, which four panels may all be on one of the mirror image pop-up elements 125, 127 or may be divided between the two. Alternatively, adhesive could be provided on the four connection panels of each pop-up element, if desired. Thereafter, the assembly is folded about the central line 117 to bring the base panels 113, 115 into superposed position, and compression may be applied if desired to assure a firm adhesive bond is achieved. Thereafter, opening of the folder to a location where the base panels 113, 115 and the adhered frame portions of the pop-up panels are in a substantially planar orientation, as depicted in FIG. 17, causes the pop-up elements 125, 127 to assume the three-dimensional figure of a box tied with ribbon in an upper bow.

Although the invention has been illustrated and described with respect to a number of embodiments, it should be understood that various changes and modifications can be made to any of these embodiments as would be obvious to one having the ordinary skill in the art without deviating from the scope of the invention which is defined by the claims appended hereto. For example, as earlier indicated, different sheet material may be employed for different portions of the pop-up construction, as desired to achieve a certain effect. Likewise, the basepiece may be provided with three, four or more panels with the pop-up construction being provided in conjunction with any adjacent panels. On the other hand, multiple pop-up constructions may be provided between adjacent pairs of interconnected base panels in such a series.

Various features of the invention are emphasized in the claims which follow.

What is claimed is:

1. An item of the character described which comprises a basepiece which includes at least two base panels each having a lateral edge which lies generally along a common line along which said panels can be folded into superposed condition, a first pop-up element attached to one base panel, a second pop-up element attached to the other base panel, said pop-up elements having lines of weakness formed therein dividing said elements into subelements, and at least one of said subelements having adhesive disposed thereon for joining said subelement in surface-to-surface contact with a subelement of said other pop-up element, whereby joinder of said last-mentioned two subelements is effected upon folding said basepiece along said common line to bring said base panels into superposed condition.

2. An item in accordance with claim 1 wherein both said pop-up elements are formed from the same sheet of material and are defined in part by a second line of weakness which is alinged with said basepiece common line.

3. An item in accordance with claim 1 wherein said pop-up elements and said basepiece are formed from the same sheet of material which sheet is folded upon itself to create the defined assembly of said basepiece and said pop-up elements, said pop-up elements being cut from said sheet of material.

4. An item in accordance with claim 3 wherein at least one of said pop-up elements is die-cut from panel of said sheet in a manner to leave a border surounding said one element which border is adhesively connected to one of said base panels.

5. An item in accordance wiith claim 4 wherein said one pop-up element is connected to said surrounding border at several locations which are designed to easily tear and cause disconnection the first time said base panels are opened from said superposed condition.

6. An item in accordance with claim 1 wherein said pop-up elements are made from sheet material and are disposed in flat planar form prior to folding of said basepiece.

7. An item in accordance with claim 6 wherein said pop-up elements are hinged to tabs which are adhesively affixed to said respective base panels.

8. An item in accordance with claim 7 wherein said subelements to be joined are each generally triangular in shape and have an edge which lies along said common line.

9. An item of the character described which comprises basepiece means providing at least two base panels each of which has one edge designed to lie along a common line when said panels are disposed in superposed condition, in which condition said panels will be interconnected to each other so as to be foladable along said common line, one base panel including a first pop-up element, the other base panel including a second pop-up element, said pop-up elements having lines of weakness formed therein dividing said elements into subelements, and at least one of said subelements having adhesive disposed thereon for joining said subelement in surface-to-surface contact with a subelement of said other pop-up element, whereby joinder of said last-mentioned two subelements is effected only after said base panels are brought into superposed condition.

10. An item in accordance with claim 9 wherein at least one of said pop-up elements is die-cut from its respective base panel.

11. An item in accordance with claim 9 wherein said basepiece means includes two separate unconnected pieces of sheet material each having a region located along said one edge on the opposite side of said common line from said base panel, said regions being attached to each other in the fabrication of the completed said item.

12. An item in accordance with claim 11 wherein said regions are designed to, upon attachment, provide a mailing envelope.

13. An item in accordance with claim 9 wherein said base panels are part of the same sheet of material and are hinged to each other along said common line whereby said base panels are brought into superposed condition by folding.

14. A method of making an item of the character described which comprises providing basepiece means which includes a plurality of base panels made from sheet material, one of said base panels including a first pop-up element, and another of said base panels including a second pop-up element, said pop-up elements each having at least one line of weakness formed therein dividing said elements into subelements, applying adhesive to said basepiece means in a zone corresponding to at least a first subelement of one pop-up element which subelement is positioned for ultimate surface-to-surface contact with a first subelement of said second pop-up element, and bringing said one and said other base panels into superposed relationship to each other so that said first subelements come in contact with each other and effecting adhesive attachement of said first subelements to each other.

15. A method in accordance with claim 14 wherein said base panels and said pop-up elements are formed from an integral sheet of die-cut material, and wherein a folding operation is performed to bring said base panels in said superposed relationship.

16. A method in accordance with claim 15 wherein said adhesive is applied to said integral sheet before die-cutting is effected to form said pop-up elements.

17. A method in accordance with claim 14 wherein said basepiece means comprises separate pieces of sheet material each of which forms one of said two base panels plus a region disposed on the opposite side of a straight line from said base panel and wherein additional adhesive is applied to one of said regions and said separate pieces are joined together with said base panels, hinged to each other along said straight line after said superposed relationship is accomplished.

* * * * *